United States Patent [19]

Zion, Jr.

[11] Patent Number: 4,551,955

[45] Date of Patent: Nov. 12, 1985

[54] SAND BLASTING APPARATUS

[76] Inventor: Henry E. Zion, Jr., 31 Bedford St., Middleboro, Mass. 02346

[21] Appl. No.: 540,844

[22] Filed: Oct. 11, 1983

[51] Int. Cl.[4] ..... B24C 5/04

[52] U.S. Cl. ..... 51/439; 239/424.5; 239/419.5

[58] Field of Search ..... 51/439, 411, 319, 320, 51/321; 239/424.5, 429, 431, 419.5

[56] References Cited

U.S. PATENT DOCUMENTS

| | | | |
|---|---|---|---|
| 2,440,334 | 4/1948 | Gerlach | 51/439 |
| 2,577,664 | 12/1951 | Pro | 239/431 |
| 2,587,184 | 2/1952 | Marjama | 51/439 |
| 2,717,476 | 9/1955 | Myers | 51/439 |
| 2,801,133 | 7/1957 | Ridley | 51/439 |
| 3,424,386 | 1/1969 | Maasberg et al. | 239/433 |

FOREIGN PATENT DOCUMENTS

| | | | |
|---|---|---|---|
| 0166500 | 10/1982 | Japan | 51/411 |

*Primary Examiner*—Frederick R. Schmidt
*Assistant Examiner*—Robert A. Rose
*Attorney, Agent, or Firm*—John P. McGonagle

[57] ABSTRACT

An apparatus fitted over the end of a sand blasting tool, for forming around the jet of sand, a thin water cocoon to eliminate sand dust during sand blasting operations. In one example, the jet of sand passes through an axial bore in the apparatus fitted over the sand blasting tool creating a negative pressure. Water, which is supplied from two chambers in the apparatus adjacent to the axial bore and located on the inner face of the apparatus at the junction of the apparatus and the sand blasting tool, is drawn by the negative pressure created by the sand jet across the inner surface of the apparatus into the axial bore around the sand jet. Air from intake holes in the apparatus causes the water to atomize as it is being drawn into the axial bore. The sheeting effect on the water across the apparatus inner surface combined with the misting effect from the air intake holes causes a thin, cylindrical mist to form around the jet of sand.

4 Claims, 6 Drawing Figures

SAND BLASTING APPARATUS

BACKGROUND OF THE INVENTION

This invention relates to sand blasting and in particular to an improved apparatus for eliminating the dust generated from sand blasting.

In ordinary methods of sand blasting the abrasive material used scatters into clouds of dust after leaving the blasted surface. When attempts were made to eliminate this dust by using moist or wet sand and the sand was wetted before its entry into the sand blasting nozzle, it clogged the nozzle as well as the line leading to the blasting nozzle.

The prior art includes various patents pertaining to sand blasting nozzles which rely on pressurized water systems which project blanketing screens of water outside the sand jet as the jet moves from the nozzle to the surface being blasted. These systems use water volumes in the six gallon per minute range at approximately forty pounds pressure. These systems do not entirely eliminate the dust cloud. They are also unwieldy and result in costly sand blasting operations.

Included in this group are: U.S. Pat. No. 2,324,250 to J. N. Voerge which relates to a sand blast apparatus with a pressurized water system for projecting a frustroconical stream or sheet of water around a jet of sand; U.S. Pat. No. 2,376,287 to T. Sorrentino which relates to a sand blasting nozzle provided with a removable water jacket having means to spray water about the jet of sand to settle the dust; U.S. Pat. No. 2,644,275 to J. Hoguet which relates to a water curtain projecting device for use with sand blasting apparatus; and U.S. Pat. No. 2,669,809 to J. R. McGrath which relates to a sand blasting apparatus and method which floods the surface immediately adjacent to the area of impact of sand with a continuous flood of water.

U S Pat. No. 2,440,334 to J. M. Gerlach relates to a sand blasting nozzle which draws moisture into the sand at about the area where the sand leaves the nozzle in such a way as to prevent the formation of dust without affecting the flow of sand through the nozzle. This system uses a high volume of water because of large water holes and does not provide the high degree of vacuum required to pull water from the nozzle to the object of the blast.

Accordingly, an object of this invention is to avoid the difficulties and inconveniences associated with sand blasting in the past by placing over the end of the sand blasting tool a device through which the sand jet passes and into which water is drawn. The water is drawn along the outer surface of the sand jet forming an atomized water enclosure through which the sand particles cannot travel without being wetted. The atomized water also forms a blanket of mist over the point of impact of the sand jet wetting the sand as it bounces back from the blasted surface. This wetting augments the sand's density causing the wet sand to fall down preventing its passage into the ambient air.

Another object of this invention is to provide a blanketing screen of water along the sand jet without requiring a pressurized water system.

Another object of this invention is to reduce the volume of water required to approximately one gallon per minute.

Another object of this invention is to provide the high degree of vacuum required to pull the water blanket from the nozzle to the object of the blast.

Another object of this invention is to provide a simple, light, inexpensive, convenient and durable apparatus by means of which the several objects set forth above may be accomplished.

BRIEF DESCRIPTION OF THE DRAWINGS

The accompanying drawings show, by way of example, one embodiment of the invention wherein.

DETAILED DESCRIPTION OF THE INVENTION

Figure 1:
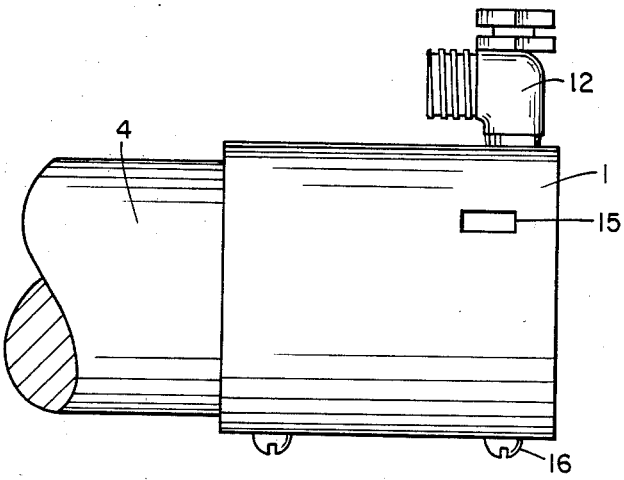
FIG. 1 is a side view of a sand blasting apparatus embodying the invention attached to a sand blasting tool.
Figure 2:
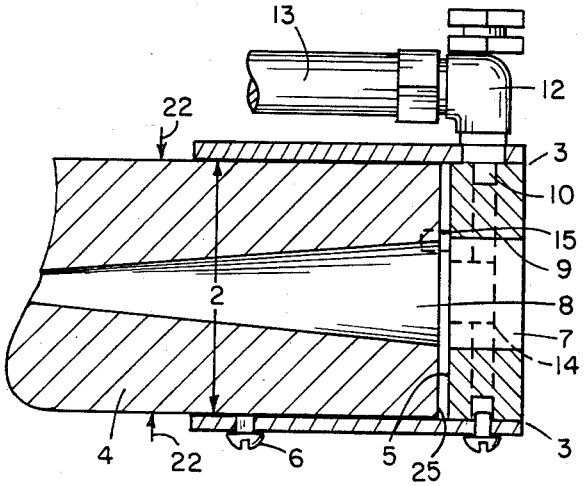
FIG. 2 is an axial cross-sectional view of the structure shown in FIG. 1.
Figure 3:
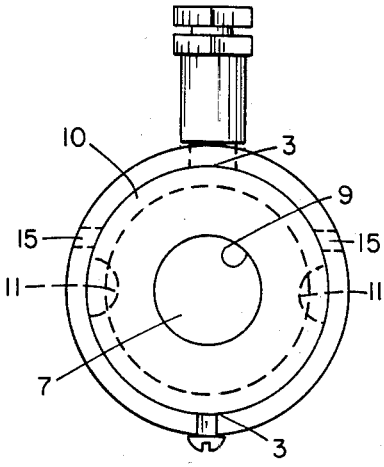
FIG. 3 is an end view of said apparatus viewed from the end where the sand blast stream emerges.
Figure 5:
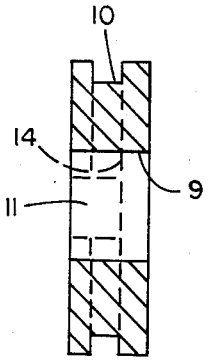
FIG. 5 is a horizontal cross-section along the line 3—3 of FIG. 3 and corresponding to FIG. 4.
Figure 4:
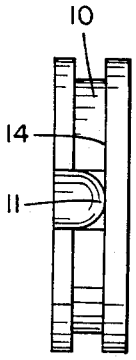
FIG. 4 is a side view along the line 3—3 of FIG. 3.
Figure 6:
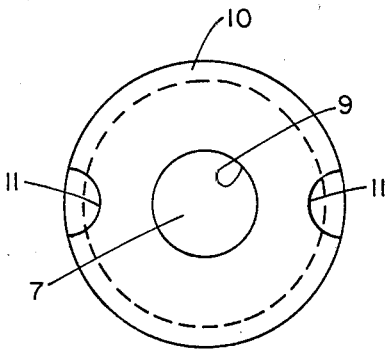
FIG. 6 is a plan view from the inside of said apparatus along the line 3—3 of FIG. 3 and corresponding to FIG. 4 and FIG. 5.

The apparatus consists essentially of an outer shell member or casing 1 as shown in FIG. 1 preferably made of a noncorrosive material such as aluminum, and having an axial bore 2 as shown in FIG. 2 in which an insert 3, generally indicated at 3—3 in FIG. 2 and FIG. 3, and wholely pictured in FIG. 4, FIG. 5 and FIG. 6, is concentrically mounted at one end of the casing 1. The insert 3 is held in place within the casing 1 on one side by the screw 16 screwed through the side of the casing 1 and having its point engaging said insert 3, and on the other side by the water fitting 12 also srewed through the side of the casing 1 and having a portion engaging said insert 3.

The casing 1 is fitted over a sand blasting tool 4 a shown in FIG. 1 and FIG. 2 whose outer diameter 22 approximately equal to the diameter of the axial bore 2. The casing 1 is fitted over the sand blasting tool 4 so that the end of the sand blasting tool 4 from which the sand jet emerges is nearly touching the insert's inner face 5. The casing 1 is secured to the sand blasting tool 4 by means of a screw 6 through the side of the casing 1 and having its point engaging the sand blasting tool 4.

The said insert 3 has an axial bore 7, shown in FIG. 2, FIG. 3 and FIG. 6, through which passes the sand jet from the sand blasting tool 4. The diameter of the insert's axial bore 7 is approximately one-sixteenth of an inch larger than the exit oriface 8 of the sand blasting tool 4 as shown in FIG. 2. This allows the sand jet which is gradually expanding due to the venturi action of most sand blasting tools to pass through the insert's axial bore 7 without touching the insert's axial bore's inner wall 9.

The said insert 3 has an annular, concentric groove 10 about its circumference as shown in FIG. 2 through FIG. 6. Juxtaposed on either side of the insert axial bore 7 are two chambers 11 opening onto the insert inner face 5. FIG. 4 shows the chamber cavities 11 as extending to the groove 10 and having a depth sufficient to reach the outer side 14 of the groove 10.

FIG. 1 and FIG. 2 show the casing 1 having attached to it a fitting 12 adapted to receive a convenient conduit 13 for supplying the apparatus with water. The fitting 12 is screwed through the casing 1 opening onto the channel formed by the groove 10. The fitting 12 and the insert 3 are positioned such that the chambers 11 are ninety degrees to either side of the fitting 12.

The casing 1 contains air intake holes 15 located generally at the junction of the insert inner face 5 and the sand blasting tool 4. The air intake holes 15 are positioned so that they are several degrees above the chambers 11 toward the fitting 12.

OPERATION

In operation as the sand under pressure is discharged through the insert axial bore 7 from the sand blasting tool 4 a negative pressure is created in the insert axial bore 7. Water is drawn by this negative pressure from the water fitting 12, along the annular concentric groove 10, into the chamber cavities 11, across the insert's inner face 5 and through the insert axial bore 7 along with the sand jet.

At the same time the negative pressure draws in air from the air intake holes 15. The interaction of air and water in the chamber cavities 11 and across the insert's inner face 5 further atomizes the water causing a very fine mist to form. The negative pressure formed by the sand jet as well as the air coming from the air intake holes cause the mist to form a cocoon around the sand. The fineness of the mist and the strength of the suction created by the negative pressure accelerates the water cocoon near to the speed of sand stream.

The water is drawn along the outer surface of the sand jet forming an atomized water enclosure through which the sand particles cannot travel without being wetted. This wetting augments their density and consequently causes them to fall down so that they cannot pass into the ambient air. The atomized water also forms a blanket of mist over the point of impact of the sand jet wetting the sand as it bounces back, causing the wetted sand particles to drop down to the ground without forming a dust cloud.

The term "sand" as used above is meant to apply to any of the kinds of grit used in sand blasting operations and is used in its generic sense.

It is understood that the above-described embodiment is merely illustrative of the application. Other embodiments may be readily devised by those skilled in the art which embody the principles of the invention and fall within the spirit and scope, thereof.

I claim:

1. An improved sand blasting apparatus of the type fitted over the end of a sand blasting tool for forming around a sand jet coming from the tool a thin water cocoon to eliminate sand dust during sand blasting operations, wherein the improvement comprises:

a hollow casing having an outside, an inside and two ends, one end into which a sand blasting tool is inserted, and said casing having an inner diameter approximately equal to the outer diameter of the sand blasting tool;

a water fitting mounted on the outside of said casing at the end opposite to that end of the casing into which the sand blasting tool is inserted, penetrating through to the inside of the casing, and adapted to receive a convenient conduit for supplying water to the inside of the casing;

a disk concentrically mounted within the said casing at the end with the said water fitting, having an axial bore through which the sand jet from the sand blasting tool passes, having an annular, concentric groove about its circumference aligned with the water fitting, having a plurality of chamber cavities juxtaposed on either side of the disk's axial bore and opening onto the face of the disk which nearly touches the sand blasting tool and having a depth sufficient to reach the side of the groove farthest away from the sand blasting tool, and to which the sand blasting tool is so inserted in the casing that it nearly touches; and a plurality of holes in the casing located generally at the junction of the disk and the sand blasting tool.

2. An improved sand blasting aparatus as recited in claim 1 wherein:

the fitting and the disk are positioned such that the chamber cavities are ninety degrees to either side of the water fitting.

3. An improved sand blasting apparatus as recited in claim 2 in wherein:

the diameter of the disk insert bore is approximately one-sixteenth of an inch larger than the exit orifice of the sand blasting tool.

4. An improved sand blasting apparatus as recited in claim 3 wherein:

the holes in the casing are positioned several degrees above the chamber cavities toward the fitting.

* * * * *